United States Patent [19]

Wysk et al.

[11] Patent Number: 4,701,063

[45] Date of Patent: Oct. 20, 1987

[54] PRINTING APPARATUS WITH DOCUMENT CUTTING DEVICE

[75] Inventors: Hans-Joachim Wysk, Villingen-Schwenningen; Dieter Stellmach, Bad Dürrheim; Bernhard Nolte, Gutach; Gerd Gronwald, Braünlingen; Werner Maedge, Villingen-Schwenningen, all of Fed. Rep. of Germany

[73] Assignee: Mannesmann Aktiengesellschaft, Fed. Rep. of Germany

[21] Appl. No.: 844,989

[22] Filed: Mar. 27, 1986

[30] Foreign Application Priority Data

Mar. 27, 1985 [DE] Fed. Rep. of Germany ..... 3510995

[51] Int. Cl.[4] ..... B41J 11/70

[52] U.S. Cl. ..... 400/621; 83/483; 83/583; 101/226

[58] Field of Search ..... 400/621, 621.1, 621.2; 270/21.1; 101/226–227; 83/469, 471.2, 483, 583

[56] References Cited

U.S. PATENT DOCUMENTS

| | | | |
|---|---|---|---|
| 3,960,080 | 6/1976 | Adahan | 400/621 |
| 4,504,162 | 3/1985 | Speraggi | 400/621 |

FOREIGN PATENT DOCUMENTS

| | | | |
|---|---|---|---|
| 7812759 | 8/1974 | Fed. Rep. of Germany | 400/621 |
| 140183 | 8/1982 | Japan | 400/621 |

*Primary Examiner*—E. H. Eickholt

*Attorney, Agent, or Firm*—Toren, McGeady & Associates

[57] ABSTRACT

A printing mechanism is provided with a rotary cutter mounted on a printing trolley to enable a recording medium or document to be cut as the printing trolley moves during a printing operation. The recording medium is supported by a platen which has a counteracting edge cooperating with the rotary cutter and a control mechanism operates to actuate the rotary cutter between an active position for cutting and a lifted inactive position with a spring operating to apply a spring force against the rotary cutter tending to urge it against the counteracting edge.

8 Claims, 7 Drawing Figures

FIG. 6
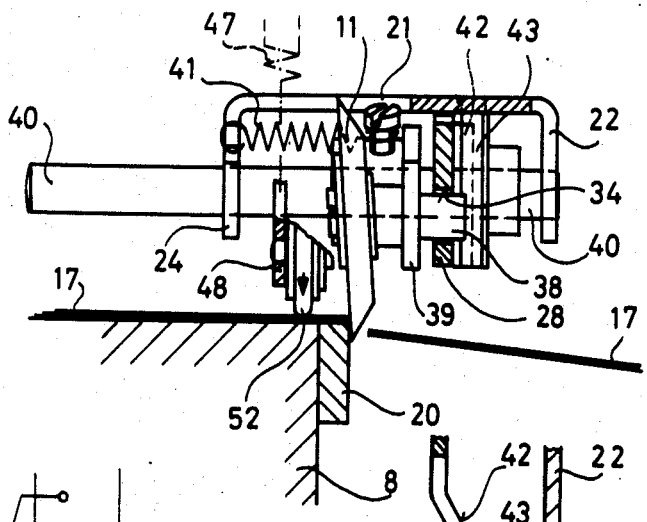
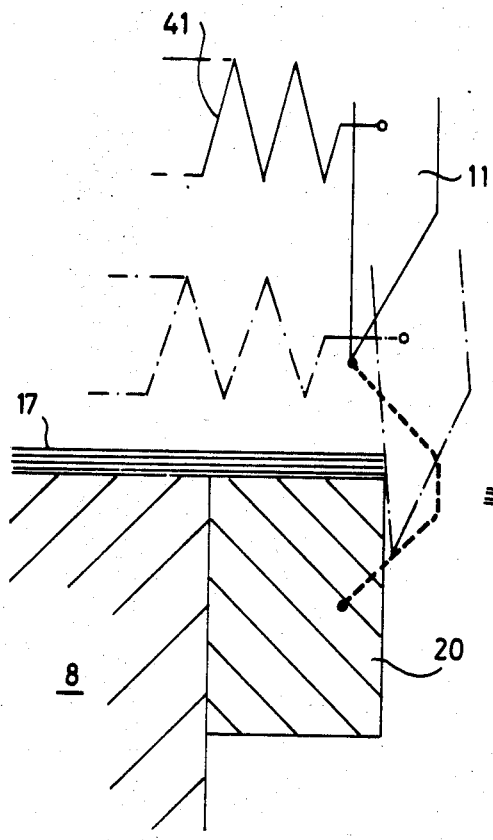
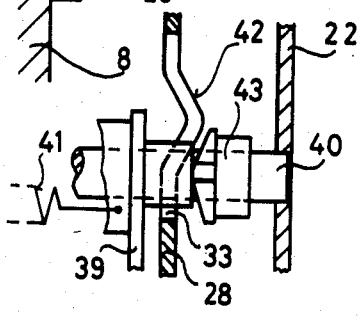
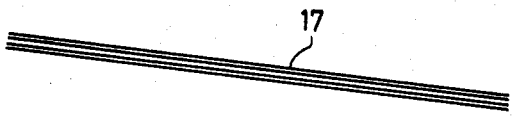
FIG. 7

PRINTING APPARATUS WITH DOCUMENT CUTTING DEVICE

The present invention is directed generally to printing apparatus and more particularly to a printing mechanism including means for cutting a document or recording medium which is to be printed.

The invention is more particularly directed to the cutting device which is arranged preferably in connection with a printing trolley of a printing unit with a rotary cutter being powered by movement of the printing trolley. The cutter cooperates with a counteracting knife edge attached at a platen or printing support base and the cutter is actuated by a control device from an inactive into an active position.

Devices of the type described herein are known in the prior art from DE-GM No. 78 12 759, wherein such a cutting device is described. The device of the prior art includes a rotary cutter which is pushed by a control apparatus from a retracted inactive position in which, normally, printing operation occurs, into an advanced or lowered position at which the cutting process may be performed. The cutting device is connected with a printing unit and cutting movement of the rotary cutter is derived from the motion of the printing trolley relative to the platen or printing support bed. In the known arrangement, the control apparatus is controlled from the inactive into the active position by stops which are rigidly fixed in the housing and approach bevels or similar devices are provided at the platen or printing support bed.

These will ensure that the cutter is brought into contact position with respect to a counteracting knife edge. The arrangement of a special stop firmly fixed in the housing for actuation of the control apparatus and of special approach bevels for rendering the rotary cutter active in the cutting position will require considerable effort.

Thus, there exists in the art a need to improve the control device for moving the rotary cutter from the inactive to the active or cutting position and particularly to simplify the structure of such a mechanism.

Thus, in view of the limitations of the prior art, the present invention is directed toward providing a device, wherein space requirements for repositioning of the rotary cutter may be diminished in order thereby to improve printing width.

A further task to which the present invention is directed relates to the retaining device for the recording medium which is to be cut which, in the prior art arrangement, is directly connected with the rotary cutter. This leads to only a point-shaped fixation of the recording medium occurring there during the cutting process, where one cuts, however, not during the initial cutting. Thereby it cannot be excluded that the recording medium is displaced to some extent at the beginning and at the end of the cutting process so that straight cutting edges cannot be formed.

With the present invention, the device is capable of retaining or holding the recording medium in such a way that deviation of the position of the recording medium at the beginning and at the end of the cutting process is avoided.

SUMMARY OF THE INVENTION

Briefly, the present invention may be described as a cutting mechanism for printing apparatus comprising platen means for supporting a recording medium during a printing operation, printing means including a printing trolley movable along the platen means in a given direction for printing upon the recording medium, rotary cutter means including a rotary cutter blade mounted on the printing means and movable with the printing trolley for cutting the recording medium, counteracting means on the platen means cooperating with the cutter blade during a cutting operation to facilitate cutting of the recording medium, control means for actuating the rotary cutter means between an active position in operative cooperation with the counteracting means at which a cutting operation may be effected and an inactive position lifted from cooperation with the counteracting means, and spring means applying a spring force to the rotary cutter means in the active position in a direction generally perpendicular to the given direction of travel of the printing means to urge the rotary cutter means against the counteractin means during a cutting operation.

In accordance with the invention, the control means consist of a control device comprising a slide having cam means which moves the rotary cutter from the inactive lifted and retracted positon into the position lowered and advanced so as to be in a cutting attitude. The rotary cutter in the cutting position is retained in contact at a cutting edge of the counteracting means by the spring means acting perpendicularly to the direction of motion of the slide. The slide receives its control movement through coaction with the lateral restrictions which limit movement of the printing trolley along said given direction.

Using the slide with its cam guides as a control device has the advantage that a smooth displacement of the rotary cutter is possible and that the rotary cutter is retained in contact with the counteracting cutting edge only through a relatively weak spring force provided by the spring means. Due to the light contact of the rotary cutter, tolerances in the guidance of the trolley are compensated and wear of the rotary cutter is reduced.

In accordance with an embodiment of the invention a third cam is provided on the cam slide of the control means which imparts to the rotary cutter movement from the retracted position into the advanced position. Through an additional second cam guide, the rotary guide is lifted and lowered, whereby the movement of the rotary cutter due to the first and second cam guides are superimposed in such a way that the rotary cutter is led along the platen means during its movement at the sharp edge of the counteracting means. For retention of the recording medium, the control device acts independently of the rotary cutter upon retention rollers which are arranged on both sides of the rotary cutter. The retention rollers are preferably retained on a balance lever which adjusts itself automatically in the retention position.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DESCRIPTION OF THE DRAWINGS

In the drawings:

FIG. 6 is a schematic side view showing parts of the mechanism during the cutting process; and FIG. 7 is a schematic representation showing movement of the rotary cutter into the cutting position.

DETAILED DESCRIPTION OF THE PREFERRED EMBODIMENTS

Figure 1:
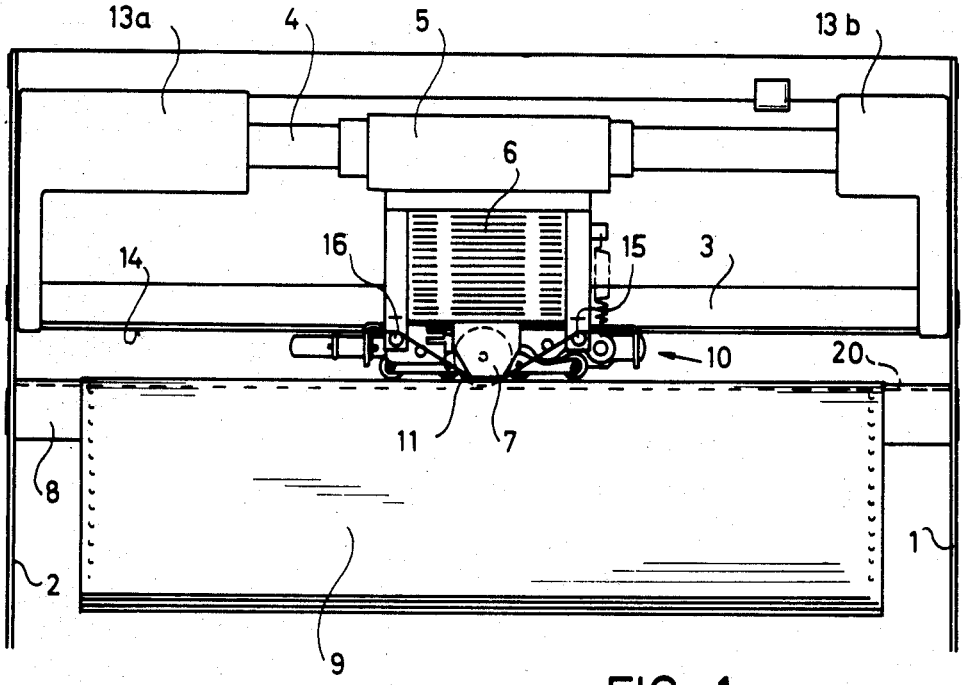
FIG. 1 is a schematic plan view of the printing apparatus with the cutting device in accordance with the present invention.

Referring now to the drawings, there is shown printing apparatus in accordance with the present invention including a mechanism for cutting a recording medium to be printed in the printing mechanism.

Referring particularly to FIG. 1, the apparatus of the invention is shown as comprising a pair of guide axles 3 and 4 which direct movement of a printing trolley 5 which is part of the printing means of the apparatus. The guide axles 3 and 4 are arranged to extend between a pair of lateral side stops or plates 1 and 2 which limit the extent of travel of the printing means. A printing head 6 is located upon the printing trolley 5 so that its mouthpiece 7 stands directly in front of a recording medium support pad or platen 8 so that printing upon a recording medium 9 may be performed.

The apparatus is provided with a cutting device 10 which is attached at the printing trolley in such a way that a rotary cutter 11 of the cutting means or device 10 may cooperate with a counteracting cutting edge 20 formed at the platen 8, as is more clearly seen in FIG. 6. An ink ribbon cassette, which consists of two parts 13*a* and 13*b* between which an ink ribbon is stretched in front of the platen 8, is additionally fixed between the lateral boundary plates 1 and 2 of the apparatus. For the purpose of guiding the ink ribbon 14, it is directed, on the one hand, around guide bolts 15 and 16 and, on the other hand, so as to lie in front of the mouthpiece 7 forwardly of the apertures through which the print needles of the print mechanism 6 protrude.

The rotary cutting mechanism 10 of the invention is shown in greater detail and will be more particularly described with references to FIGS. 2, 3, 4 and 5.

Figure 2:
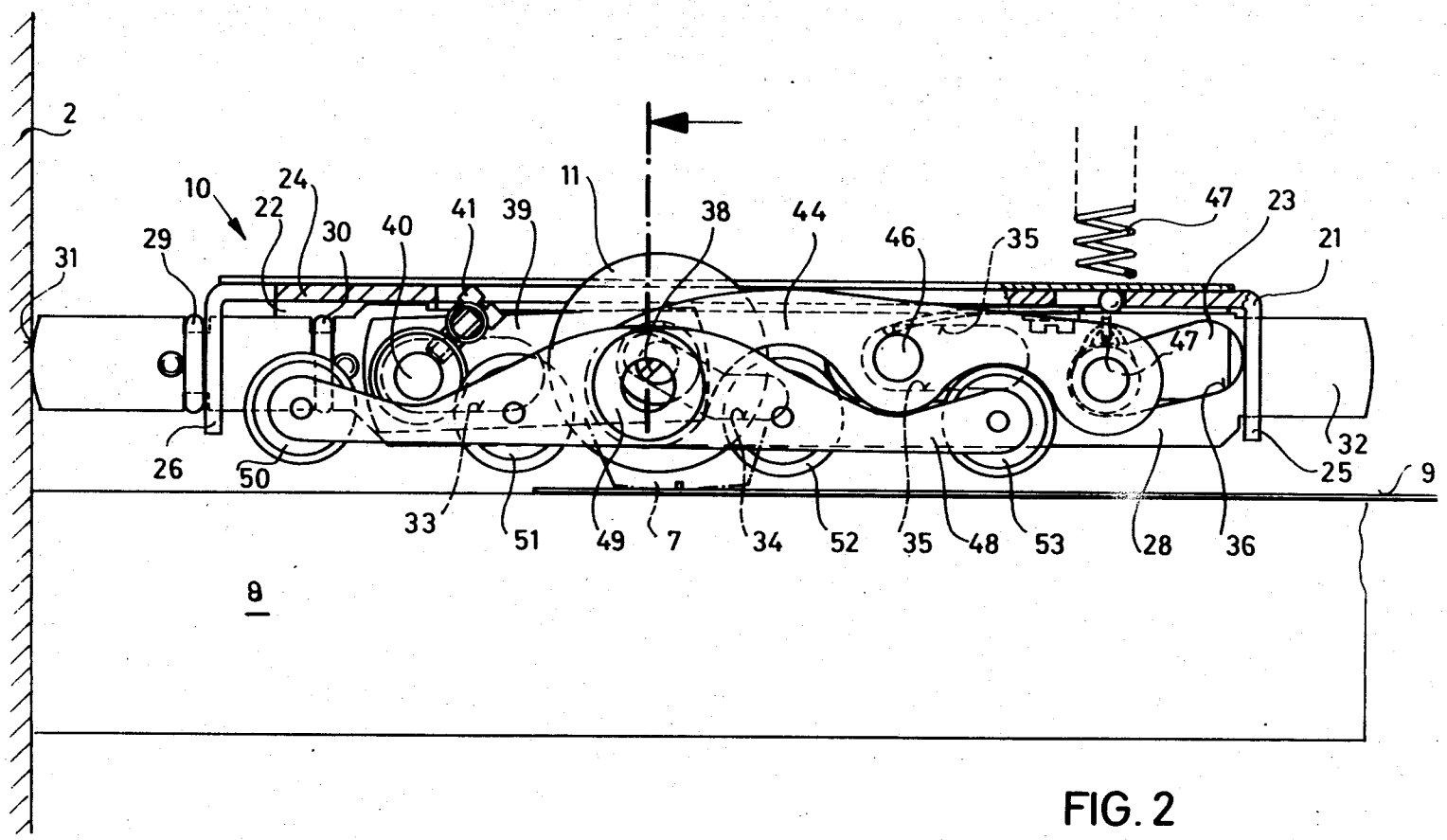
FIG. 2 is a partial front view showing the cutting device in the inactive position.

Referring first to FIG. 2, the cutting mechanism is shown in the inactive position at which the rotary cutter 11 is not positioned to effect a cutting operation and, in this position, the printing head 6, 7 may act upon the recording medium 9 which is fed onto the platen means 8. As will be particularly discerned from FIG. 6, the counteracting means in the form of a counteracting cutting edge 20 is attached at the front side of the platen 8 which cooperates with the rotary cutter 11 and causes shearing off of the recording medium 9 if appropriately controlled.

Figure 3:
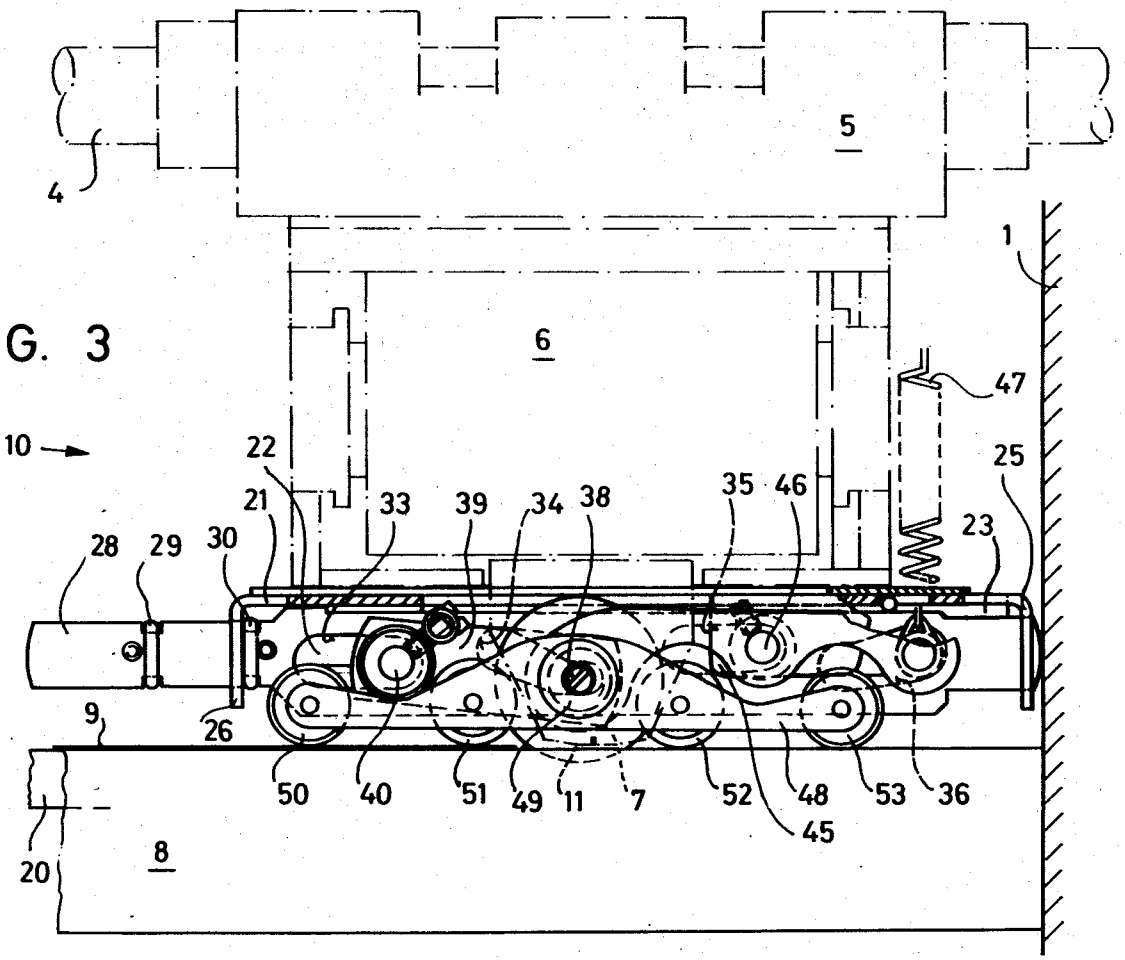
FIG. 3 is a front view showing the cutting device in the active or cutting position.

FIG. 3, on the other hand, shows the cutting device in the active or cutting position, in which position, the rotary cutter 11 operates in cooperation with the counteracting cutting edge 20 in order to shear off individual segments of the printing medium 9.

Figure 5:
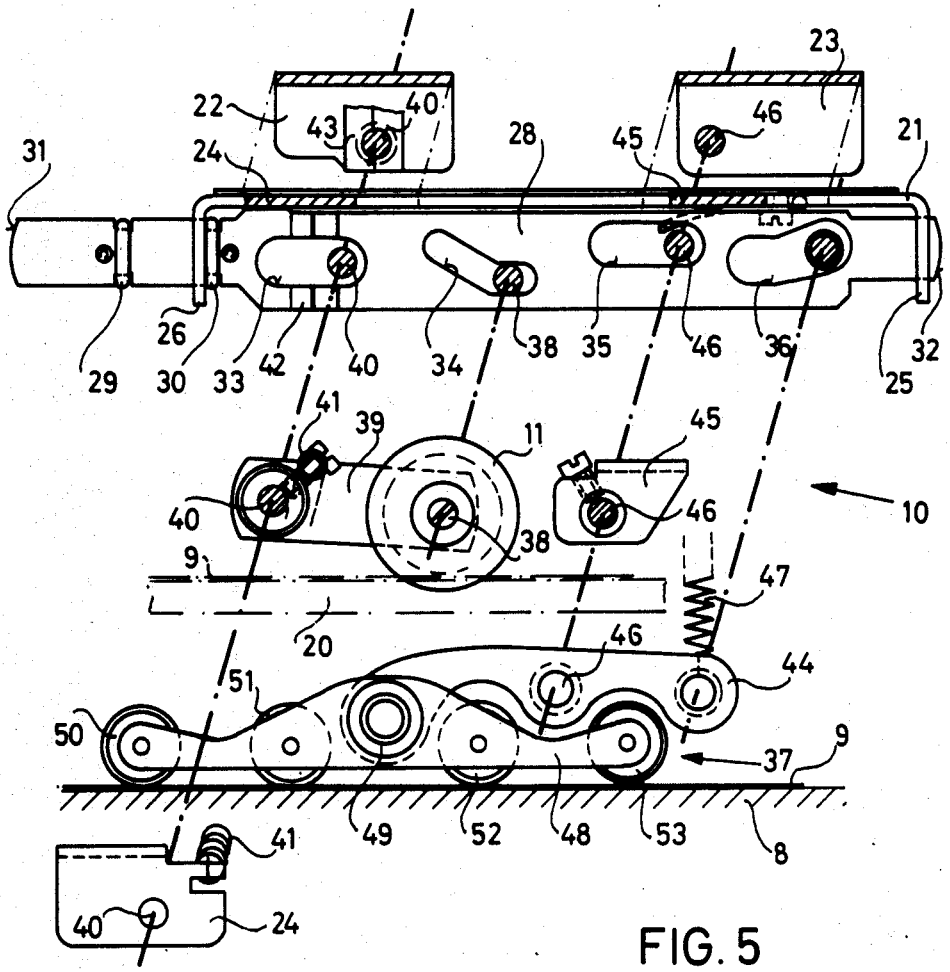
FIG. 5 is an exploded view showing portions of the cutting mechanism.

The printing apparatus is provided with a support part or member 21 which carries all of the parts of the cutting mechanism 10. As is best seen in FIG. 5, the support member 21 is a stirrup-shaped angled part which, at the front and at the rear thereof, consists of bent tabs 22, 23, 24 and 45. The support member 21 is provided with angular bends or tabs 25 and 26 at its sides, with the bends 25 and 26 operating to support and guide different active portions of the cutting mechanism 10.

The control means of the invention for controlling operation of the cutting mechanism 10 comprises a slide 28 which is retained and guided at the ends thereof in the bent tabs 25 and 26 of the support member 21. The slide 28 is formed with two abutment beads 29 and 30 which limit its displacement or movement. The slide 28 pushes with its ends 31 and 32 against the lateral boundaries 1 and 2, which limit movement of the printing trolley 5, whereby the rotary cutter 11 is displaced into the active or inactive position.

The slide 28 has an aperture 33, a cam guide 34, an aperture 35 and a third cam guide 36. The aperture 33 and the cam guide 34 serve for control of the rotary cutter 11. The cam guide 36 serves for control of a set of retaining rollers 37. The rotary cutter is rotatably supported on a lever 39 by means of a bolt 38. The lever 39 is connected with an axle 40 which is supported to be rotatable and axially displaceable in the bent tabs 22 and 24 of the support member 21.

A spring 41 acts upon the axle 40 and also upon the lever 59 as well as upon the rotary cutter 11 in such a way that the rotary cutter rests against the counteracting cutting edge 20 in a resilient manner in the active position as is shown, for example, in FIG. 6. The slide 28 is provided with an angled bend or nose 42 in the area of the aperture 33, while a cam follower 43 is arranged on the axle 40, as can be seen from FIG. 4. Parts 33, 42, 43 together form a first cam guide means which serves for the forward and backward displacement of the rotary cutter 11. If, for example, the slide 28 is moved from left to right, as seen in FIG. 4, then the axle 40 will follow this movement by means of the cam follower 43 and the angled bend 42 in the slide 28 so that the rotary cutter will be moved out of its retracted inactive position into an advanced active position.

Figure 4:
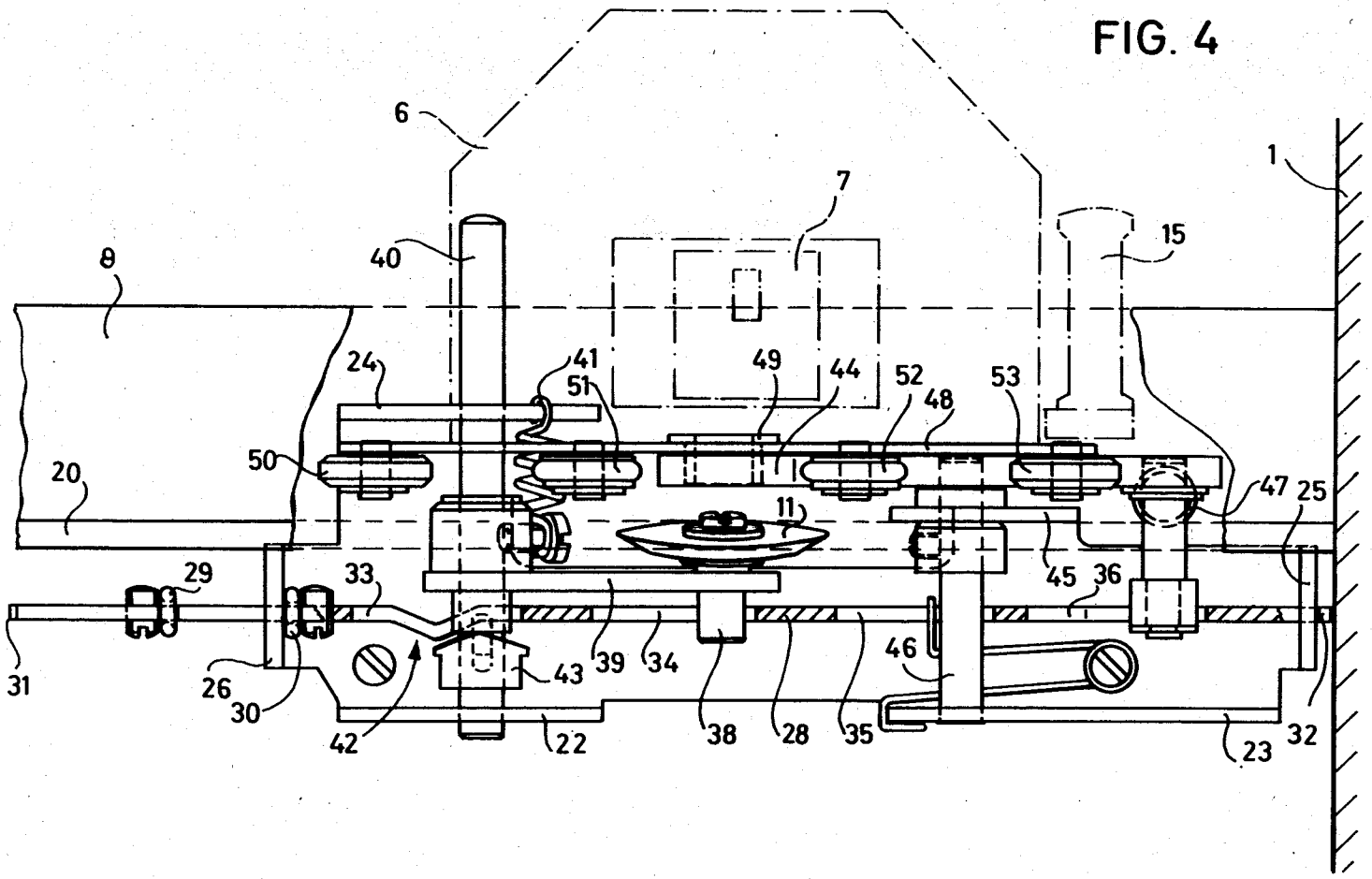
FIG. 4 is a side view of the cutting device of the invention.

It should be observed, as will be discerned from FIG. 4, that the cam follower does not rest at the cam guide 33 of the slide 28, rather it is pressed against the counteracting cutting edge 20 in a fixable manner by the spring 21 which is connected with the lever 39. If, however, the slide 28 is moved from right to left in FIG. 4, then the cam guide 33 of the slide 28 with its angled bend 42 and the cam follower 43 at the axle 40 causes a retraction of the rotary cutter 11 so that it is pushed out of the active position with the counteracting cutting edge. The spring 41 is a relatively weak spring, whereby the wear of the rotary cutter is reduced and the tolerances of the platen are compensated.

In addition to the first cam guide means 33, 42, 43, an additional or second cam guide 34 is provided into which there engages the bolt 38 at the rotary cutter 11. The shape of the cam guide 34, as shown in FIG. 5, will indicate that the rotary cutter 11 is also lifted or lowered by means of the slide 28. The cam guide 33 with the angled bend 42 also has the function to move the rotary cutter 11 forwardly and backwardly, while the cam guide 34 operates to lift and lower the cutter 11. In the advanced lowered position, the cutter 11 is in its effective or active position and, in the retracted or lifted position, the cutter is inactive or ineffective.

The control means consisting of the slide 28 not only controls the lifting and lowering and the forward and rearward movements of the rotary cutter into or out of the cutting position, but it also controls the retention device 37 which operates to move the printing medium 9 in front of and behind the rotary cutter and which is activated independently of the rotary cutter 11. For this purpose, the slide 28 is provided with an additional aperture 35 and a cam guide 36. A control lever 44 is supported upon an axle 46 between the angled tab 23 and an additional angled tab 45 of the support member 21.

The spring 47 biases the control lever 44 as shown in FIG. 5 in a counterclockwise direction. It should be noted that the aperture 35 in the slide 28 is traversed only by the shaft 46, whereby no control operations are effected upon the lever 44. The control function is rather performed by the cam guide 36 which ensures that the control lever 44 can pivot a balance lever 48 from its ineffective position, for example, as shown in FIG. 2, into an active or effective position according to FIG. 3. The balance lever 48 is pivotably supported upon a bolt 49 at the control lever 44 and carries two front and two rear retaining rollers 50, 51, 52 and 53. It should be noted that the axle 38 of the rotary cutter 11 is coaxial with the support axle 49 of the carrier lever 48. Because of this, the two retaining rollers 50, 51 are, on the one hand, assigned to the cutting position and the two retaining rollers 52 and 53 are, on the other hand, assigned to the cutting position of the rotary cutter 11. By means of actuation of the retaining rollers 50–53 over the slide 28 and the cam guide 36, which is independent of the rotary cutter, it is assured that both elements independently of each other may resiliently rest upon the cutting beam or the platen 8. At the same time, the mechanism operates so that the recording medium 9 is already held by the two retaining rollers 50, 51 or 52, 53 before the start or after the termination of the cutting process. In order to improve contact of the two retaining rollers 50, 51 on the one hand, and 52, 53 on the other hand, the inner rollers 51, 52 are provided with a more elastic coating than the outer rollers 50, 53. In this manner, it is assured that at the beginning and at the end of the cutting process, no displacement of the recording medium can occur during cooperation between the rotary cutter 11 and the cutting edge 20 so that a clean cut at right angles to the boundary edges can always be assured.

The cutting operation occurring precisely at this time is shown in FIG. 6 in sectional representation. It will be seen that the rotary cutter 11 rests against the cutting edge of the counteracting cutter 20 only under a very light force of the spring 41.

FIG. 7 depicts in a magnified representation the pattern of movement of the rotary cutter 11 from the lifted or retracted position, according to FIG. 2, into the lowered or active position. The broken line shows that the rotary cutter 11 is advanced and lowered by means of the two cam guides 33 and 34. For performance of the movement, no additional initial positioning bevels or actuation bolts are required at the printer itself. The redirection occurs rather merely by the cooperation of the two ends 31 and 32 of the slide 28 with the two lateral side plates 1 and 2. If it is not necessary to cut, then it is merely necessary for control of the printer trolley 5 to occur in such a manner that reversal of the movement occurs prior to reaching the side plates 1 and 2.

Thus, it will be seen from the foregoing that the present invention is directed to a cutting mechanism for the recording medium in a printing apparatus which is particularly intended to be connected with the printing trolley of the printing unit. The rotary cutter 11 operates together with the counteracting cutting edge 20 in cooperation therewith and it is driven by the movement of the printing trolley 5. The slide 28 with the cam guides 33–36 operates as a control means for displacement of the rotary cutter from the inactive retracted position to the active advanced position. The slide 28 is actuated by abutment of the printing trolley 5 at the two lateral side plates 1, 2, whereby the rotary cutter 11 is lifted and lowered or advanced or retracted. Retaining rollers 50–53 for the recording medium 9 are provided upon a balance lever 48 also actuated by the slide 28 which are arranged on both sides of the cutting position so that the recording medium is held by the retaining rollers 50–53 prior to the start of the cutting process and also after termination thereof.

While specific embodiments of the invention have been shown and described in detail to illustrate the application of the inventive principles, it will be understood that the invention may be embodied otherwise without departing from such principles.

What is claimed is:

1. Printing apparatus including a mechanism for cutting a recording medium comprising:

platen means for supporting a recording medium during a printing operation;

printing means mounted to be movable along said platen means in a given direction for printing upon said recording medium;

rotary cutting means including a cutter blade and means mounting said cutter blade on said printing means and movable therewith for cutting said recording medium;

counteracting means on said platen means cooperating with said cutter blade during a cutting operation to facilitate cutting of said recording medium;

control means for actuating said rotary cutter means between an active position in operative cooperation with said counteracting means at which a cutting operation may be effected and an inactive position lifted from cooperation with said counteracting means; and spring means applying a light spring force to said rotary cutter means when in said active position in a direction generally perpendicular to said given direction of travel of said printing means to urge said rotary cutter means against said counteracting means during a cutting operation;

said control means comprising a slide member and means mounting said slide member to be longitudinally movable between two opposed terminal end positions, said apparatus further including lateral restraint means which define said terminal end positions and which also operate to limit the movement of said printing means;

said apparatus further comprising first cam guide means defined by said slide member and a first axle cooperating with said first cam guide means and connected with said rotary cutter to actuate said rotary cutter means between said active and said inactive positions.

2. Apparatus according to claim 1, further comprising second cam guide means defined by said slide member, a second axle engaging said second cam guide means and having said rotary cutter means supported thereon and pivotable lever means engaging said second cam guide means and having said rotary cutter means rotatably supported thereon to effect pivotal motion of said pivotable lever means in such a manner that the movement of said rotary cutter means proceeds in a superimposed manner by operation of said first and second cam guide means.

3. Apparatus according to claim 1, further comprising retaining roller means controlled by said control means and means whereby said roller means is supported independently of said rotary cutter means, said roller means acting on said recording medium on both sides of said rotary cutter means to hold said recording medium on said platen means.

4. Apparatus according to claim 3, including a balance lever upon which said retaining roller means are arranged and means whereby said balance lever automatically adjusts itself in a retaining position.

5. Apparatus according to claim 4, wherein said retaining roller means comprise two pairs of retaining rollers, one each arranged on opposite sides of said rotary cutter means.

6. Apparatus according to claim 5, wherein one pair of said retaining rollers is arranged adjacent to said rotary cutter means and is provided with a more elastic coating than the other pair of said retaining rollers.

7. Apparatus according to claim 4, including a control lever for moving said balance lever from an inactive retracted position into an active position.

8. Apparatus according to claim 7, further comprising third cam guide means defined on said slide member for actuating said control lever.

* * * * *